US006895880B2

(12) United States Patent
Nakajima et al.

(10) Patent No.: US 6,895,880 B2
(45) Date of Patent: May 24, 2005

(54) ACCESS PORT DECK STRUCTURE FOR A PERSONAL WATERCRAFT

(75) Inventors: Jun Nakajima, Saitama (JP); Tadaaki Nagata, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/660,108

(22) Filed: Sep. 11, 2003

(65) Prior Publication Data

US 2004/0123787 A1 Jul. 1, 2004

(30) Foreign Application Priority Data

Sep. 11, 2002 (JP) ..... 2002-266084

(51) Int. Cl.[7] ..... B63B 35/73
(52) U.S. Cl. ..... 114/55.51; 114/55.53
(58) Field of Search ..... 440/88 A; 114/55.51, 114/55.53

(56) References Cited

U.S. PATENT DOCUMENTS 5,743,206 A 4/1998 Hattori
5,839,930 A * 11/1998 Nanami et al. ..... 440/88 L
2001/0000052 A1 * 3/2001 Yamada et al. ..... 114/55.53

* cited by examiner

*Primary Examiner*—Stephen Avila
(74) *Attorney, Agent, or Firm*—Carrier, Blackman & Associates, P.C.; William D. Blackman; Joseph P. Carrier

(57) ABSTRACT

In a personal watercraft 10, an access port structure is provided in which a main service opening 93 and a secondary service opening 98 for maintenance are provided in a deck 20 of the personal watercraft 10, the main service opening 93 and the secondary service opening 98 are provided at positions at which a maintenance operation can be performed with one hand of an operator M let in the main service opening 93 and with the other hand of the operator M let in the secondary service opening 98. For example, the operator can let the left hand thereof into the main opening and let the right hand into the secondary service opening to perform a maintenance operation using both hands. As a result, improvement of the operability of the maintenance operation can be achieved.

15 Claims, 12 Drawing Sheets

(a)

(b)

ACCESS PORT DECK STRUCTURE FOR A PERSONAL WATERCRAFT

CROSS-REFERENCE TO RELATED APPLICATIONS

The present application claims priority under 35 U.S.C. 119, based on Japanese patent application No. 2002-266084, filed Sep. 11, 2002.

BACKGROUND OF THE INVENTION

1. Field of the Invention

The present invention relates to an access port structure formed in a deck of a personal watercraft. More particularly, the present invention relates to an access port deck structure for a personal watercraft that permits maintenance to be given to said personal watercraft in an efficient and convenient manner, making multiple uses of openings in the deck of said personal watercraft to effect maintenance and hull access.

2. Description of the Relevant Art

A personal watercraft is known as a small size craft that is constructed and arranged to glide on the surface of a sea or lake. Many jet skis and other different types of personal watercraft are known and are commercially available.

Various access port structures are known which provide an opening in the deck of a personal watercraft, to allow a service person to perform maintenance inside the deck thereof. The specification of Hattori, U.S. Pat. No. 5,743,206 discloses one such access port structure.

FIG. 13 of the present specification is similar to FIG. 3 of the specification of U.S. Pat. No. 5,743,206, and is included herein for purposes of discussion in relation to the background art, although the numbers have been changed from those used by Hattori.

Referring now to FIG. 13, the access port structure 230 of Hattori's personal watercraft includes left and right openings 237 and 238 provided for maintenance access in left and right side walls 235 and 236, respectively, of an accommodation section 234. The accommodation section is formed on a deck 233 of a watercraft, and is provided to cover an engine 232 attached to a craft body 231.

With the access port structure 230 for a personal watercraft described above, however, only the left and right openings 237 and 238 into each of which one hand can be let are provided in the left and right side walls 235 and 236. Therefore, for example, when a maintenance operation is to be performed on the left of the craft body 231, it is performed through the left opening 237, but when a maintenance operation is to be performed on the right of the craft body 231, it is performed through the right opening 238. However, it is difficult to perform a maintenance operation making use of both of the left and right openings 237 and 238 at the same time.

Further, in the design of Hattori, the left and right openings 237 and 238 are used only for a maintenance application. However, at a location where an engine and so forth are mounted and the internal layout is crowded with such members, it is desirable to use the left and right openings 237 and 238 also for additional applications other than the maintenance application.

SUMMARY OF THE INVENTION

Therefore, the present invention provides an access port method and apparatus which allows a maintenance operation to make use of two openings at the same time, and allows the openings to be used also for an application other than maintenance.

The present application provides an engine cover for a personal watercraft, in which the engine cover is more ergonomically designed than prior art engine covers.

In order to achieve the object described above, in a first illustrative embodiment of the present invention, an improved access port structure for a personal watercraft is provided, in which both a main opening and a secondary service opening for maintenance are provided in a deck of the personal watercraft. The access port structure hereof is constructed so that the main opening and the secondary service opening can be accessed simultaneously by an operator, who can perform a maintenance operation with one hand let in the main opening, and with the other hand of the operator let in the secondary service opening.

It is preferable that a maintenance operation can be performed making use of both of the openings at the same time, in order to improve the operability of the maintenance operation.

Therefore, the main opening and the secondary service opening are provided at positions at which the operator can perform a maintenance operation with one hand let in the main opening and with the other of the operator let in the secondary service opening. Consequently, for example, the operator can let the left hand thereof into the main opening and let the right hand into the secondary service opening to perform a maintenance operation using both hands.

As a result, improvement of the operability of maintenance operations can be achieved.

In another application of the present invention, an access port structure for a personal watercraft is provided in which the main opening and the secondary service opening are provided around a steering shaft.

For example, around the steering shaft, many rotatable members are present. Therefore, where the main opening and the secondary service opening are provided around the steering shaft, it is possible to hold one of the members with the left hand, and perform a maintenance operation of another member with the right hand.

The access port structure for a personal watercraft according to another embodiment of the invention is characterized in that, when the secondary service opening is closed up with a second lid, the second lid serves also as an attaching portion for an intake/exhaust duct.

This allows a single opening in the watercraft to be used for maintenance, and also to be used for another application under normal operating conditions, in order to use parts efficiently.

Therefore, when the secondary service opening is closed up with the second lid, the second lid serves also as an attaching portion for the intake/exhaust duct. Consequently, in a state of use, the second lid is utilized as an intake port or as an exhaust port.

However, upon maintenance, the second lid is removed, whereupon the intake/exhaust duct is also simultaneously removed. Consequently, a maintenance operation can be more readily performed.

As a result, efficient utilization of parts can be anticipated. Further, the number of openings used exclusively for maintenance can be reduced, and improvement of the design of the personal watercraft can be anticipated.

In still another application of the present invention, an access port structure for a personal watercraft is provided in a front portion of a deck of a personal watercraft. The portion of the deck containing the access port structure is distended upwardly to form a distended portion, and a steering handle member is rotatably supported at a central upper portion of the distended portion. The steering handle member and a steering nozzle are also disposed in the deck, and an access port opening, which is usable to perform maintenance, is formed in a side wall of the distended portion.

Since the access port opening is disposed in the side wall of the distended portion, maintenance of the connection member connecting to the steering handle member can be readily performed. As a result, improvement of the operability of the maintenance of the connection member can be anticipated.

The present invention exhibits the following effects due to the configuration described above.

According to the first embodiment, the main opening and the secondary service opening are provided at positions at which the operator can perform a maintenance operation with one hand thereof let in the main opening, and with the other hand thereof let in the secondary service opening. Consequently, for example, the operator can let the left hand thereof into the main opening and let the right hand into the secondary service opening to perform a maintenance operation using both hands.

As a result, improvement of the operability of the maintenance operation can be achieved.

For example, around the steering shaft, many rotatable members are present.

Accordingly, the main opening and the secondary service opening may be provided around the steering shaft, so that it is possible to hold one of the members with the left hand, and to perform a maintenance operation on another member with the right hand.

According to another variation of the invention, when the secondary service opening is closed up with the second lid, the second lid may be made to also serve as an attaching portion for the intake/exhaust duct. Consequently, in a state of use, the second lid is utilized as an intake port for intake air or an exhaust port. However, upon maintenance, the second lid is removed, whereupon the intake/exhaust duct is pulled off simultaneously. Consequently, a maintenance operation can be readily and easily performed.

As a result, efficient utilization of parts can be anticipated. Further, the number of openings for exclusive use for maintenance can be reduced, and improvement of the design of the personal watercraft can be anticipated.

As previously noted, an access port opening may be formed in the side wall of the distended portion, so that maintenance of the steering handle member and the related connection member can be performed readily. As a result, improvement of the operability of the maintenance of the connection member can be anticipated.

For a more complete understanding of the present invention, the reader is referred to the following detailed description section, which should be read in conjunction with the accompanying drawings. Throughout the following detailed description and in the drawings, like numbers refer to like parts.

BRIEF DESCRIPTION OF THE DRAWINGS

FIG. 4(*b*) is a view similar to FIG. 4(*a*), with the extra addition of a bridge member secured in place over a boundary between the openings.

FIG. 5(*b*) is a view similar to FIG. 4(*b*), but with an inner lid secured in place over the rear portion opening and the rear cover.

FIG. 7(*b*) is a schematic side elevational view similar to FIG. 7(*a*), but which shows the personal watercraft which adopts the access port structure according to the present invention.

DETAILED DESCRIPTION

Figure 1:
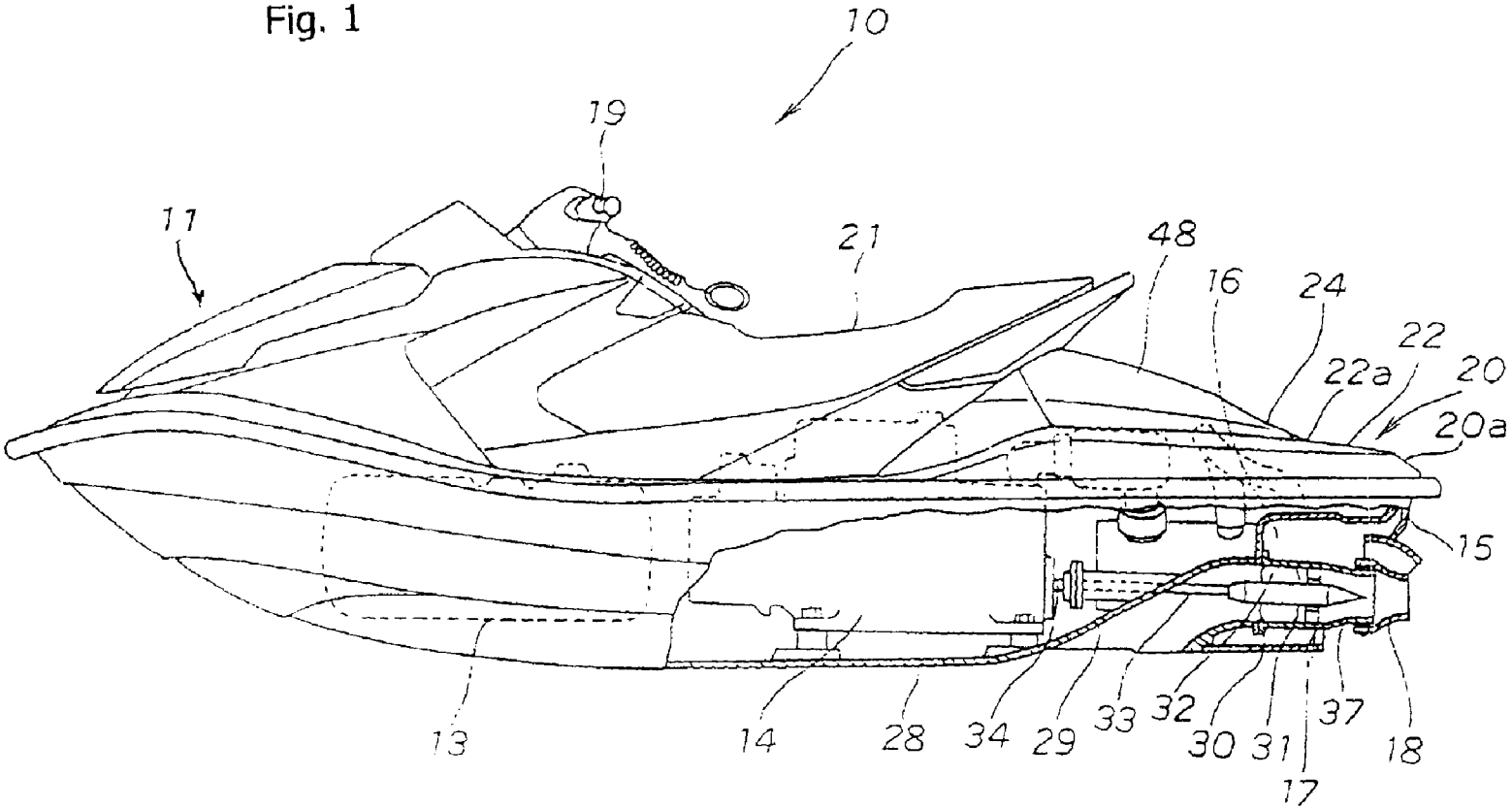
FIG. 1 is a side elevational view of a personal watercraft, which includes an access port structure according to the present invention, and with an engine and various other equipment shown via partial cutaway and broken lines.

In the following description, specific selected embodiments of the present invention are described with reference to the accompanying drawings. Herein, the terms "front", "rear", "left" and "right" represent directions as viewed from the vantage point of a driver. It is to be noted that the drawings should be viewed in the direction of reference characters.

FIG. 1 is a side elevational view of a personal watercraft which adopts an access port structure according to the present invention.

The personal watercraft 10 includes a hollow craft body 11 with a fuel tank 13 provided at a front portion thereof. The craft body 11 includes a deck 20, which forms an upper section thereof. An engine 14 is provided behind the fuel tank 13 inside the craft body 11. A jet propeller chamber 16 is provided at a stern 15 behind and below the engine 14, with a water jet propeller 17 provided in the jet propeller chamber 16, and a steering nozzle 18 provided in back of the water jet propeller 17.

A steering handle member 19, for operating the steering nozzle 18, is provided above the fuel tank 13. A seat 21 is provided at a central portion of the craft body 11, rearwardly of the steering handle member 19 such that it extends forwardly and rearwardly. A rear platform 22 is provided in back of the seat 21, such that it extends substantially horizontally forwardly from a rear end 20*a* of the deck 20. An inclined face portion 24 having an upward slope is provided such that it extends toward the seat 21 from a front end center (front end) 22*a* of the rear platform 22. A cover (rear cover) 48 is provided between the seat 21 and the rear platform 22.

The water jet propeller 17 has an inlet port 29 formed in a craft bottom 28 of the craft body 11 thereof. The inlet port 29 extends to the jet propeller chamber 16. A cylindrical stator 31 is provided on a wall portion (stator plate) 30 of the jet propeller chamber 16. An impeller 32 is disposed in the stator 31. A drive shaft 34 is connected to a shaft 33 of the impeller 32. The drive shaft 34 is a shaft having a front end connected to the engine 14 for outputting driving power of the engine 14.

During operation of the personal watercraft 10, the impeller 32 can be rotated through the shaft 33 by rotating the drive shaft 34 via the engine 14. When the impeller 32 rotates, water can be taken ingested by the inlet port 29 and introduced into the stator 31.

The thus ingested water can be introduced to the steering nozzle 18 through a jet nozzle 37 at a rear end of the stator 31 and then expelled rearwardly as a water jet from the rear end of the steering nozzle 18. The jet water can be utilized to propel the personal watercraft 10.

Figure 2:
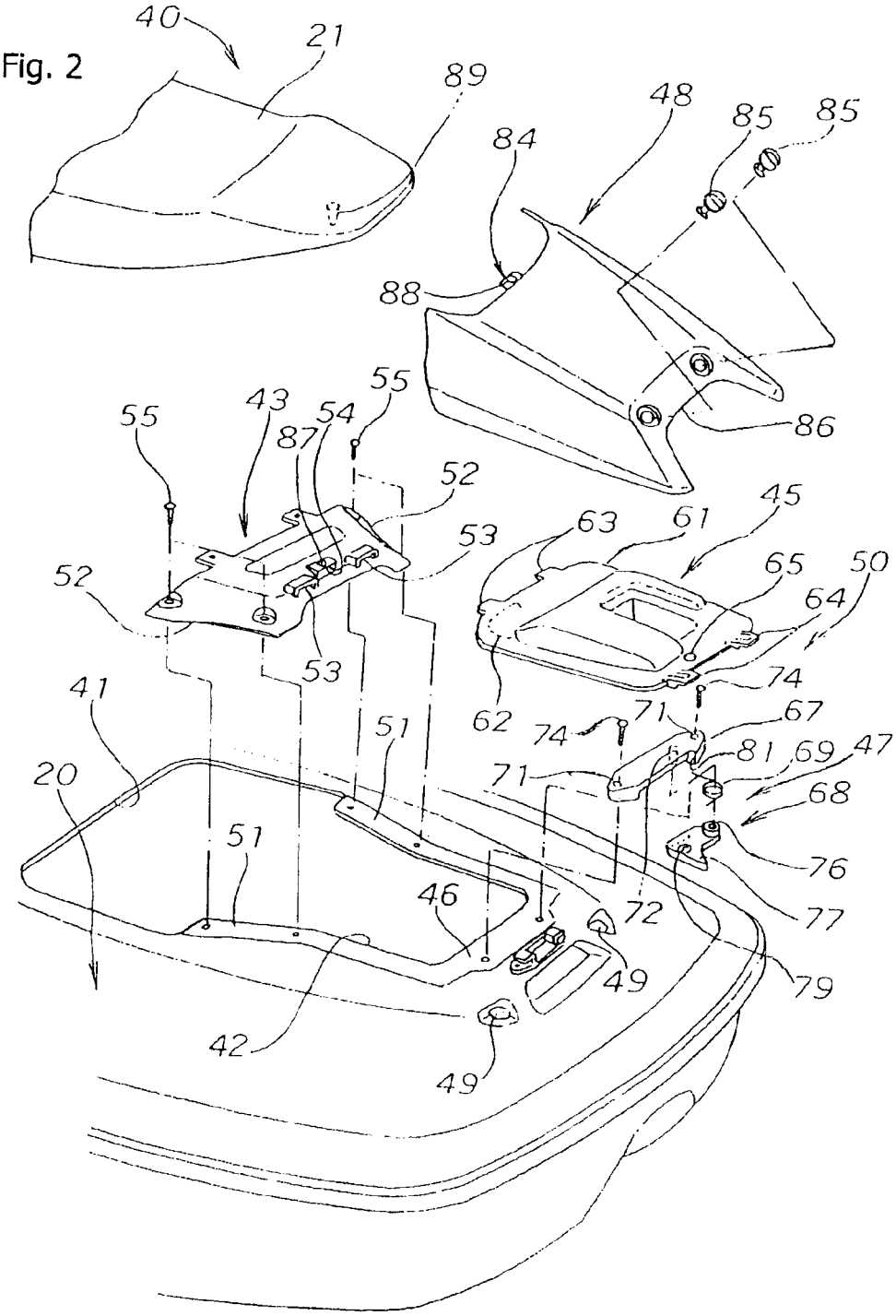
FIG. 2 is an exploded perspective view of a rear portion of the personal watercraft of FIG. 1, which adopts the access port structure according to the present invention.

FIG. 2 is an exploded perspective view of a rear portion of the personal watercraft which adopts the access port structure according to the present invention. The rear portion of the personal watercraft 10 has a seat-underlying opening 41 provided in the deck 20, with a rear portion opening 42 provided in the deck 20 continuous with and adjoining the seat-underlying opening 41. It may be considered that the seat-underlying opening 41 and the rear portion opening 42 are both parts of a single opening in the back of the watercraft 10.

A bridge plate 43 is provided for attaching to the deck 20 to define a boundary between the seat-underlying opening 41 and the rear portion opening 42. The seat 21 covers and closes up the seat-underlying opening 41, and an inner lid 45 is also provided for covering and closing up the rear portion opening 42. A locking mechanism 47 is attached to a rear edge 46 of the rear portion opening 42, as shown, for locking the inner lid 45.

A rear cover 48 is also provided to cover the inner lid 45, and the back of the rear cover 48 fits into a pair of engaging portions 49, 49 provided on the deck 20 for that purpose.

In particular, it can be considered that the deck structure 40 of the personal watercraft is configured such that the seat-underlying opening 41 is provided as an opening formed in the deck 20 of the personal watercraft 10, and the rear portion opening 42 is provided continuously to the rear of, and in communication with the seat-underlying opening 41.

The bridge plate 43 is removably attached to deck to form a boundary between the seat-underlying opening 41 and the rear portion opening 42, such that the rear portion of the seat 21 is supported by the bridge plate 43 and the rear portion opening 42 is closed up with the rear cover 48.

The engine and other equipment is arranged inside of the craft body 11 below the deck 20 of the personal watercraft. When maintenance of the engine and other equipment is to be performed, in most cases, it is performed through the seat-underlying opening with the seat removed. Accordingly, it is preferable that the seat-underlying opening be made large.

Therefore, the rear portion opening 42 is provided continuously to and in communication with the rear of the seat-underlying opening 41. The bridge plate 43 is removably mounted across the back of the seat-underlying opening to form a boundary between the seat-underlying opening 41 and the rear portion opening 42, such that the rear portion of the seat 21 is supported by the bridge plate 43, and the rear portion opening 42 is closed up with the rear cover 48.

When maintenance of the engine 14 and other equipment is to be performed, the bridge plate 43 is removed. As a result, the seat-underlying opening 41 and the rear portion opening 42 are connected to each other, and therefore, a large opening can be obtained. Consequently, improvement of the operability in maintenance can be anticipated.

Subsequently, details of the components mentioned above are described.

Bridge Plate

The bridge plate 43 includes a pair of flange portions 52, 52 formed on opposite side edges thereof, for attaching the bridge plate 43 to the deck 20 on inner side edges 51, 51 thereof adjacent the rear portion opening 42. The bridge plate also includes a pair of left and right concave fitting portions 53, 53 for receiving tabs of the inner lid 45, and a central fitting portion 54 for receiving a central tab 84 of the rear cover 48. It is to be noted that reference characters 55 denote screws for fastening the bridge plate 43 to the inner side edges 51, 51 of the deck, adjacent the rear portion opening 42.

Inner Lid

The inner lid 45 is generally in the form of a molded plate, and has a gasket 62 attached to an edge 61 thereof for sealing the rear portion opening 42. The inner lid 45 also includes a pair of spaced-apart front projections 63, 63 extending outwardly at the front end thereof for inserting into the left and right fitting portions 53, 53 of the bridge plate 43. The inner lid 45 also includes a pair of spaced-apart rear projections 64, 64 for placement on a rear edge 46 of the deck 20 adjacent the rear portion opening 42, and a fitting projection 65 situated between the rear projections 64, 64, for engaging with the locking mechanism 47.

The Locking Mechanism

The locking mechanism 47 includes a lock base 67 for attaching to the deck 20, a locking member 68 attached for swinging pivotal movement, within a predetermined range, relative to the lock base 67, and a torsion spring 69 serving as a biasing member extending between the locking member 68 and the lock base 67.

Lock Base

The lock base 67 has a pair of attaching holes 71, 71 formed therein, for use in attaching the lock base 67 to the deck 20. The lock base 67 also includes a pivot pin 72 for supporting the locking member 68 for pivotal swinging movement thereon, a spring anchoring portion (not shown) for anchoring one end of the torsion spring 69, and a stopper portion 81, for restricting the range of the swinging movement of the locking member 68 to a predetermined angle. It is to be noted that reference numerals 74, 74 denote fastening screws for attaching the lock base 67 to the deck 20.

Locking Member

The locking member 68 has a mounting hole 76 formed therein or thereon, in which the pivot pin 72 of the lock base 67 is fitted to allow swinging movement, and a projection 77 is formed at a corner of the locking member 68 farthest from the supporting hole 76. A spring anchoring portion (not shown) is provided on the locking member for anchoring the other end of the torsion spring 69, as well as a fitting recess 79 into which the projection 65 of the inner lid 45 is to be fitted.

Torsion Spring and Operation of the Lock

The torsion spring 69 is a member which biases the locking member outwardly towards the rear of the watercraft. The position of the locking member 68, with respect to the deck 20, is called the locked position when the locking member is oriented as shown in FIG. 5(*b*), and the torsion spring 69 is restrained by the inner lid 45, as shown in FIG. 5(*b*).

Figure 5A:
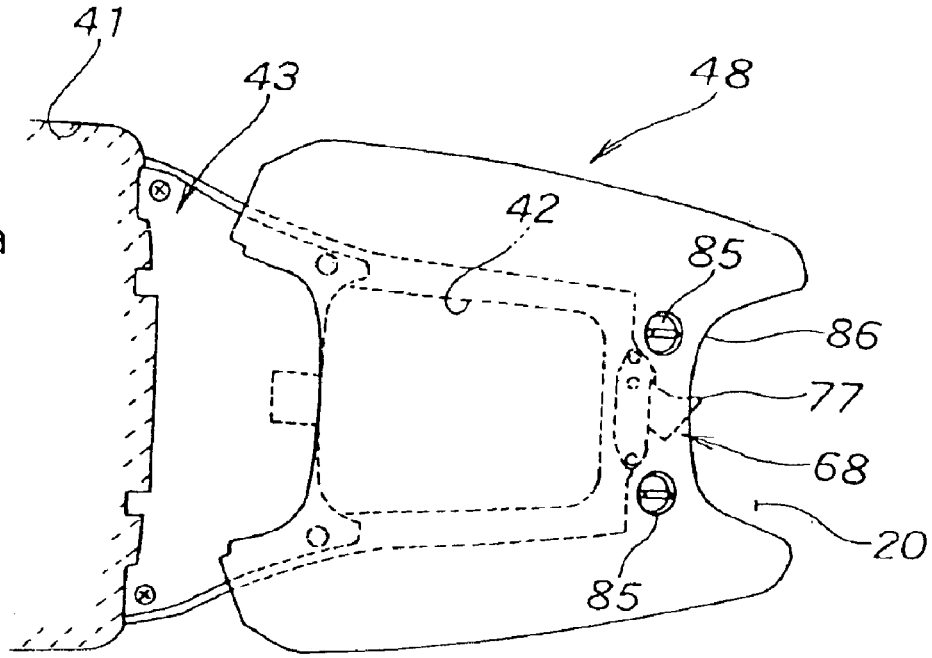
FIG. 5(*a*) is a schematic top plan view similar to FIG. 4(*b*), with the extra addition of a rear cover also disposed over the rear cover opening.
Figure 5B:
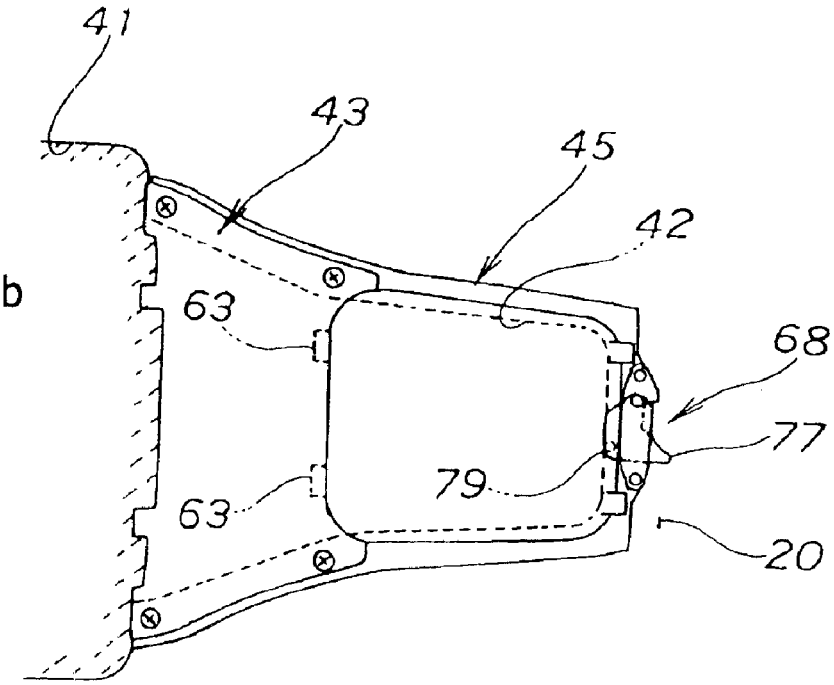

Conversely, the position of the locking member 68 with respect to the deck 20 is called the unlocked position when the inner lid 45 is removed, and the torsion spring is allowed to bias the locking member 68 outwardly, until it contacts the stopper 81 of the lock base 67, as shown in FIG. 5(*a*).

In particular, when the locking member is in the locked position, and the fitting recess 79 of the locking member 68 is fitted over the fitting projection 65 on the top of the inner lid 45, then the locking member 68 is retained in the locked position by engagement of the projection 65 in the fitting recess 79, as shown in FIG. 5(*b*).

However, when the fitting recess 79 is removed from the fitting projection 65, the inner lid 45 can be removed. Thereupon, the locking member 68 is automatically swung by the spring 69 to the predetermined angle, and when the inner lid 45 is not present, the locking member 68 is normally kept in an unlocked posture at the unlocked position, as shown in FIG. 5(*a*).

Rear Cover

The rear cover 48 is a substantially tunnel-shaped cover, and has a central projection 84 at a central front portion thereof, for insertion into the central fitting portion 54 of the bridge plate 43. The rear cover 48 also has a pair of engaging knobs 85, 85 rotatably attached to a rear portion thereof, for locking engagement with the engaging portions 49, 49 of the deck 20. Reference numeral 86 denotes a rear edge of the rear cover.

Moreover, it is also to be noted that reference numeral 87 denotes a through-hole perforated in the central fitting portion 54, reference numeral 88 denotes a through-hole perforated in the central projection 84, and reference numeral 89 denotes a downwardly projecting pin formed on a lower face of the seat 21. When the seat 21 is to be attached, the downwardly projecting pin 89 is inserted into the through-hole 88 at the front of the rear cover 48, to secure seat to the rear cover.

Figure 3:
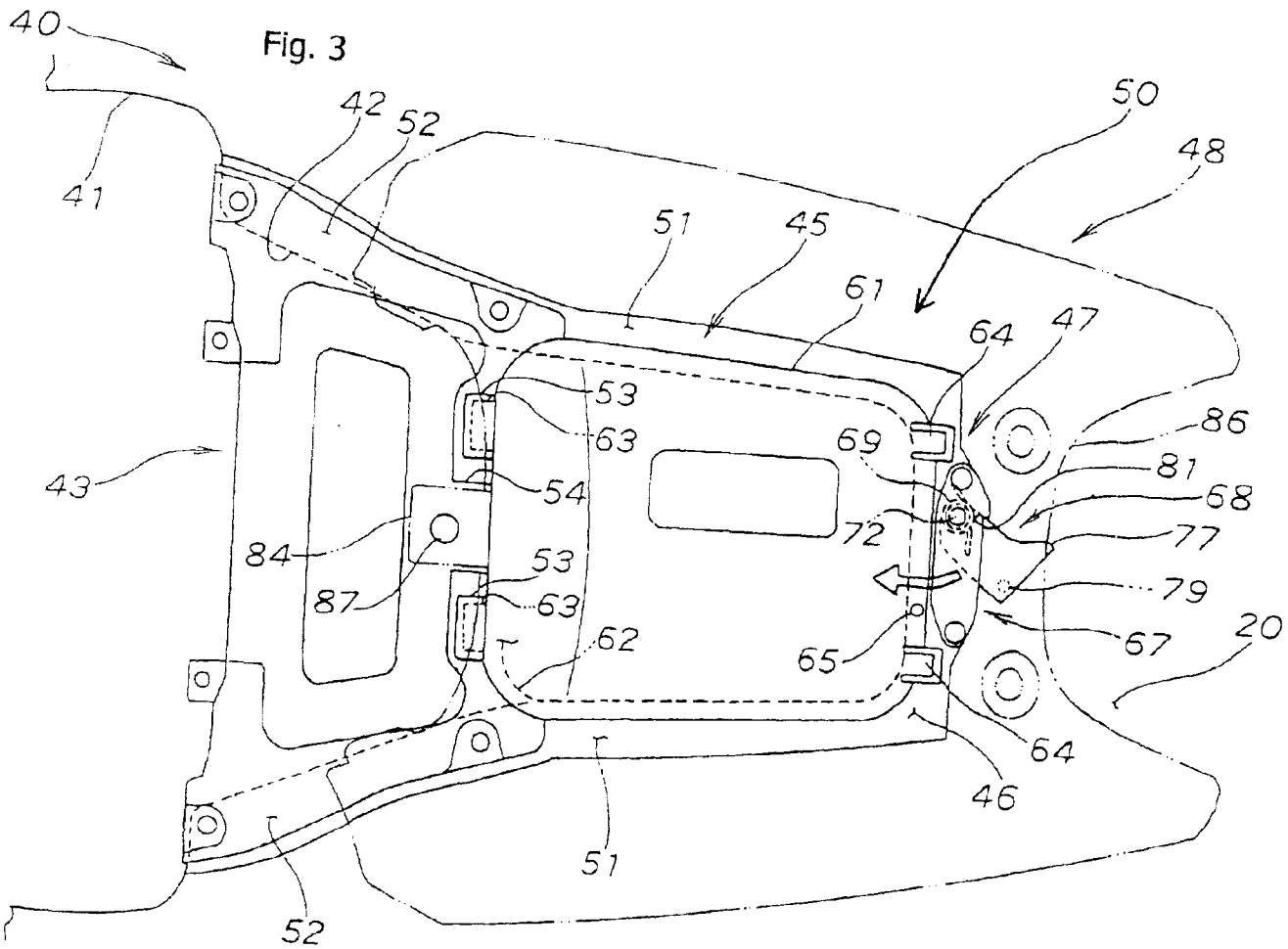
FIG. 3 is a top plan view of the rear portion of the personal watercraft of FIGS. 1–2, which adopts the access port structure according to the present invention.

FIG. 3 is a plan view of the rear portion of the personal watercraft which adopts the access port structure according to the present invention. As shown in FIG. 3, the bridge plate 43 attaches to the deck 20 to form a boundary between the seat-underlying opening 41 and the rear portion opening 42 (or to the rear portion opening 42). The front projections 63, 63 of the inner lid 45 are inserted in the left and right fitting portions 53, 53 of the bridge plate 43. The inner lid 45 is locked with the locking member 68 of the locking mechanism 47. The central projection 84 of the rear cover 48 is inserted in the central fitting portion 54 of the bridge plate 43. The rear cover 48 is engaged by the engaging portions 49, 49 on the deck 20 side.

As hereinafter described, it is shown that, when the locking member 68 is in the unlocked position thereof, illustrated in FIGS. 3 and 4, the projection 77 of the locking member 68 is held between the deck 20 and the rear cover 48, and as a result, when the locking member 68 is in the unlocked position, the rear cover 48 cannot be attached.

In contrast, the locked position is a position at which the locking member is recessed, and the fitting recess 79 of the locking member 68 is fitted with the fitting projection 65 of the inner lid 45.

The inner lid attaching structure 50 of the personal watercraft is configured such that, in the personal watercraft 10 (refer to FIG. 1) when the inner lid 45 is attached to the deck 20 adjacent the rear portion opening 42 provided therein, the gasket 62 is interposed between the inner lid 45 and the deck 20. In this configuration, the outer edge 61 of the inner lid 45 rests on the side edges 51, 51 adjacent the opening 42, and the locking member 68 is rocked inwardly to the locking side to assure the air-tightness of the inner lid 45, as indicated by the outlined arrow mark. The inner lid 45 is covered with the rear cover 48.

The projection 77 of the locking member 68 is provided integrally thereon. The projection 77 allows attachment of the rear cover 48 when the locking member 68 is at the locked position, but the projection is sandwiched between the deck 20 and the rear cover 48, to block attachment of the rear cover 48, when the locking member 68 is at the unlocked position. The torsion spring (biasing member) 69 is provided, between the locking member 68 and the deck 20, for biasing the locking member 68 toward the unlocked position.

For example, in the structure wherein the inner lid is attached to the opening provided in the deck and is covered from above with the cover, it is preferable to configure the structure such that the cover cannot be attached if the inner lid is not present, in order to prevent the inner lid from being inadvertently omitted.

Therefore, the inner lid 45 is attached to the rear portion opening (opening) 42 with the gasket 62 interposed therebetween. Further, the edge 61 of the inner lid 45 placed on the side edges 51, 51 and the rear edge 46 of the rear portion opening 42 is pressed by the locking member 68 rocked to the locking side to assure the air-tightness of the inner lid 45 and the inner lid 45 is covered with the rear cover 48.

When the inner lid 45 is removed from the deck 20, the torsion spring (biasing member) 69 automatically returns the locking member 68 to the unlocked position. If it is tried to attach the rear cover 48 when the locking member 68 is at the unlocked position, then the projection 77 of the locking member 60 is sandwiched between the deck 20 and the rear cover 48 thereby to block attachment of the rear cover 48.

Consequently, if the inner lid 45 is not attached, then the rear cover 48 cannot be fitted. As a result, the inner lid 45 can be prevented from being inadvertently omitted.

Action of the inner lid attaching structure 50 of the personal watercraft described above is described below.

Figure 4A:
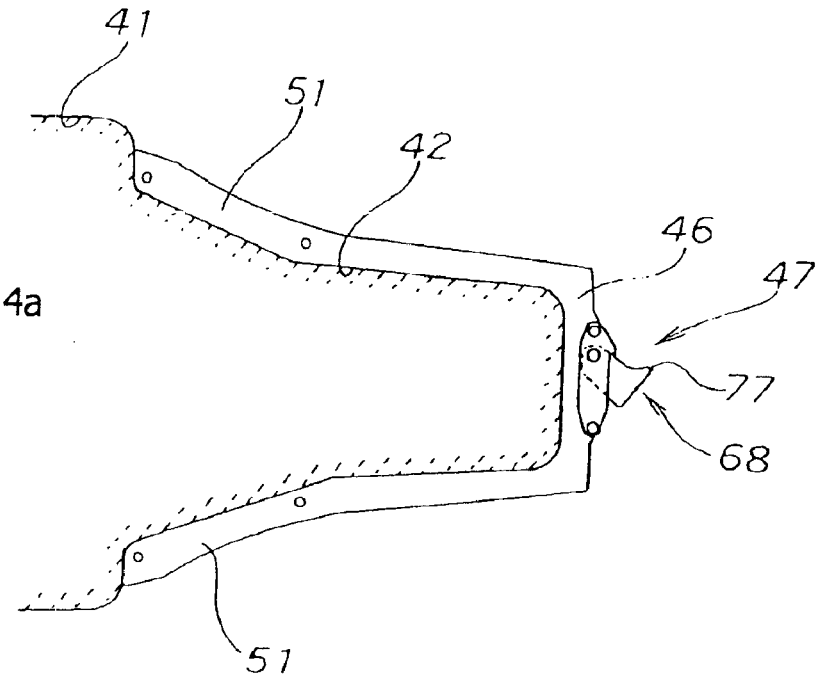
FIG. 4(*a*) is a schematic top plan view of part of the rear portion of the personal watercraft of FIGS. 1–3, in which the continuously extending seat-underlying and rear portion openings are fully exposed.
Figure 4B:
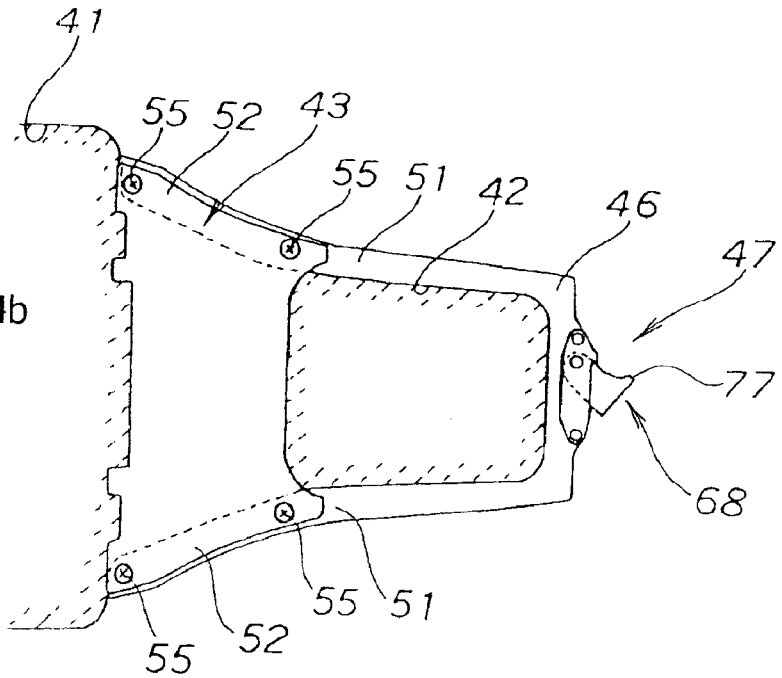

FIG. 4(*a*) is a schematic top plan view of part of the rear portion of the personal watercraft of FIGS. 1–3, in which the continuously extending seat-underlying and rear portion openings are fully exposed.

Referring to FIG. 4(*a*), the deck 20 before the bridge plate 43, inner lid 45 and cover 48 shown in FIG. 2 are attached is shown. In particular, the seat-underlying opening 41 and the rear portion opening 42 are openings which are in an open state and are contiguous to each other, and the locking member 68 is in a state wherein it maintains an unlocked state at the unlocked position.

FIG. 4(*b*) is a view similar to FIG. 4(*a*), with the extra addition of a bridge member secured in place over a boundary between the openings.

Referring to FIG. 4(*b*), the flange portions 52, 52 of the bridge plate 43 are placed onto the side edges 51, 51 of the rear portion opening 42 and secured by means of fastening screws 55.

FIG. 5(*a*) is a schematic top plan view similar to FIG. 4(*b*), with the extra addition of a rear cover also disposed over the rear cover opening.

Referring to FIG. 5(*a*), action in the case wherein it is tried to attach the rear cover 48 while the inner lid 45 shown in FIG. 2 is not attached inadvertently is described.

Since the inner lid 45 is not attached as yet, the locking member 68 keeps the unlocked posture at the unlocked position, and if the rear cover 48 is adjusted to a predetermined position of the deck 20, then the rear edge 86 of the rear cover 48 is sandwiched by the projection 77 of the locking member 68. Accordingly, the engaging knobs 85, 85 of the rear cover 48 do not fit with the engaging portions 49, 49 (FIG. 2) of the deck 20, and the rear cover 48 cannot be attached.

Consequently, if the inner lid 45 (refer to FIG. 2) is not attached, then the rear cover 48 cannot be fitted. As a result, prevention of the inner lid 45 from being not attached inadvertently can be achieved.

FIG. 5(*b*) is a view similar to FIG. 4(*b*), but with an inner lid secured in place over the rear portion opening and the rear cover.

In FIG. 5(*b*), the front projections 63, 63 of the inner lid 45 are inserted into the left and right fitting portions 53, 53 (refer to FIG. 2) of the bridge plate 43, and the fitting recess 79 of the locking member 68 is fitted with the fitting projection 65 (refer to FIG. 2) of the inner lid 45. As a result, the inner lid 45 is pressed by the locking member 68, and the locking member 68 is kept in the locked position at the locked position shown in FIG. 5(*b*).

Figure 6:
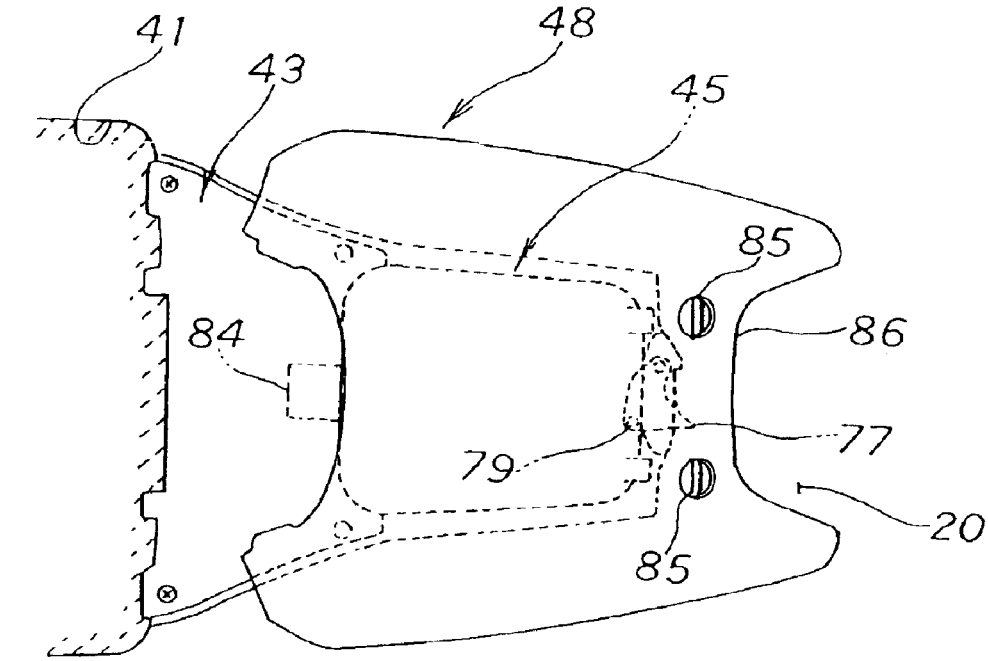
FIG. 6 is a schematic top plan view similar to FIG. 5(*b*), but with both the inner lid and the rear cover properly secured in place over the rear portion opening.

FIG. 6 is a schematic top plan view similar to FIG. 5(*b*), but with both the inner lid and the rear cover properly secured in place over the rear portion opening.

The central projection 84 of the rear cover 48 is inserted into the central fitting portion 54 (refer to FIG. 2) of the bridge plate 43, and the engaging knobs 85, 85 of the rear cover 48 are engaged by the engaging portions 49, 49 (refer to FIG. 2) of the deck 20, thereby completing the attachment of the inner lid 45 and the rear cover 48.

In particular, the inner lid attaching structure 50 of the personal watercraft is a structure wherein, when the inner lid 45 is removed from the deck 20, the torsion spring 69 (refer to FIG. 2) automatically returns the locking member 68 to the unlocking position shown in FIG. 5(*a*), and if it is tried to attach the rear cover 48 when the locking member 68 is at the unlocking position, then the projection 77 of the locking member 68 is sandwiched between the deck 20 and the rear cover 48 to block the attachment of the rear cover 48. Thus, the inner lid attaching structure 50 of the personal watercraft is a structure which can achieve prevention of the inner lid 45 from being not attached inadvertently.

Figure 7A:
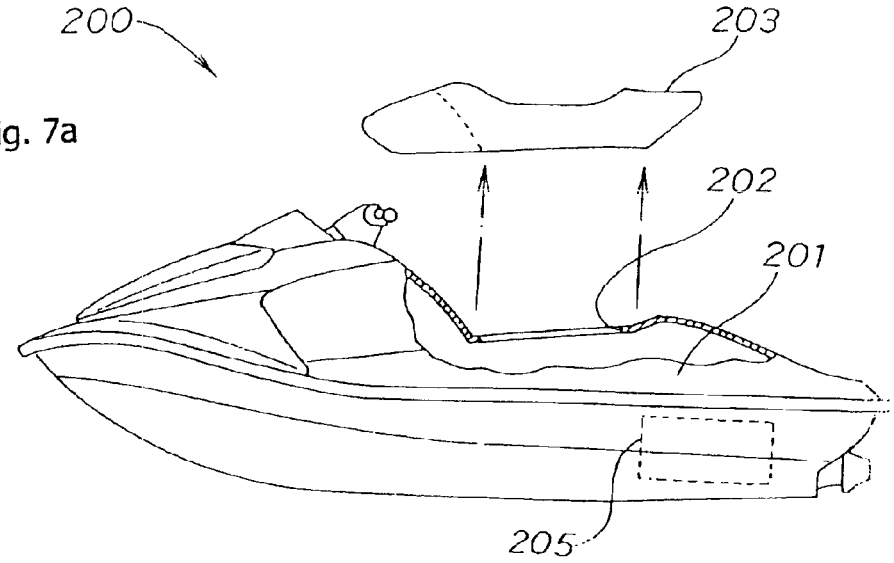
FIG. 7(*a*) is a schematic side elevational view, partly cut away, showing a personal watercraft with a comparative access port structure wherein a seat is shown separated from the deck structure.
Figure 7B:
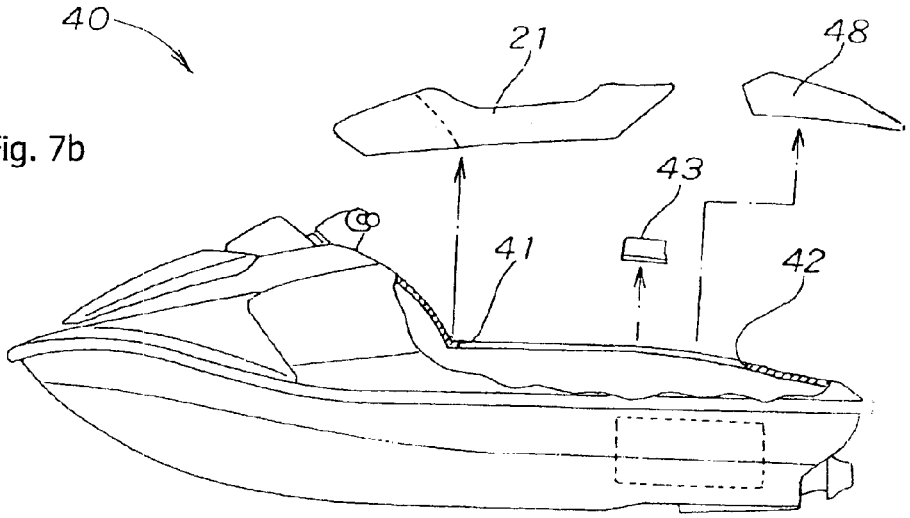

FIG. 7(*a*) is a schematic side elevational view, partly cut away, showing a personal watercraft with a comparative access port structure wherein a seat is shown separated from the deck structure.

Referring to FIG. 7(*a*), according to the deck structure 200 of the personal watercraft, a seat-underlying opening 202 is provided in a deck 201 and closed up with a seat 203. When maintenance of an engine and other equipments inside of the deck 201 is performed, maintenance of equipment 205 spaced away from the seat-underlying opening 202 cannot be performed readily.

FIG. 7(*b*) is a schematic side elevational view similar to FIG. 7(*a*), but which shows the personal watercraft which adopts the access port structure according to the present invention.

Referring to FIG. 7(*b*), according to the deck structure 40 of the personal watercraft, the rear portion opening 42 is provided continuously to the rear of the seat-underlying opening 41, and the bridge plate 43 is removably attached to the boundary between the seat-underlying opening 41 and the rear portion opening 42 (or to the rear portion opening 42) such that it supports the rear portion of the seat 21 while the rear portion opening 42 is closed up with the rear cover 48.

Accordingly, when maintenance of the engine 14 (refer to FIG. 1) and other equipments is to be performed, the bridge plate 43 is removed. Thereupon, the seat-underlying opening 41 and the rear portion opening 42 join together, and consequently, a large opening can be obtained. Consequently, improvement of the operability in maintenance can be achieved.

Figure 8:
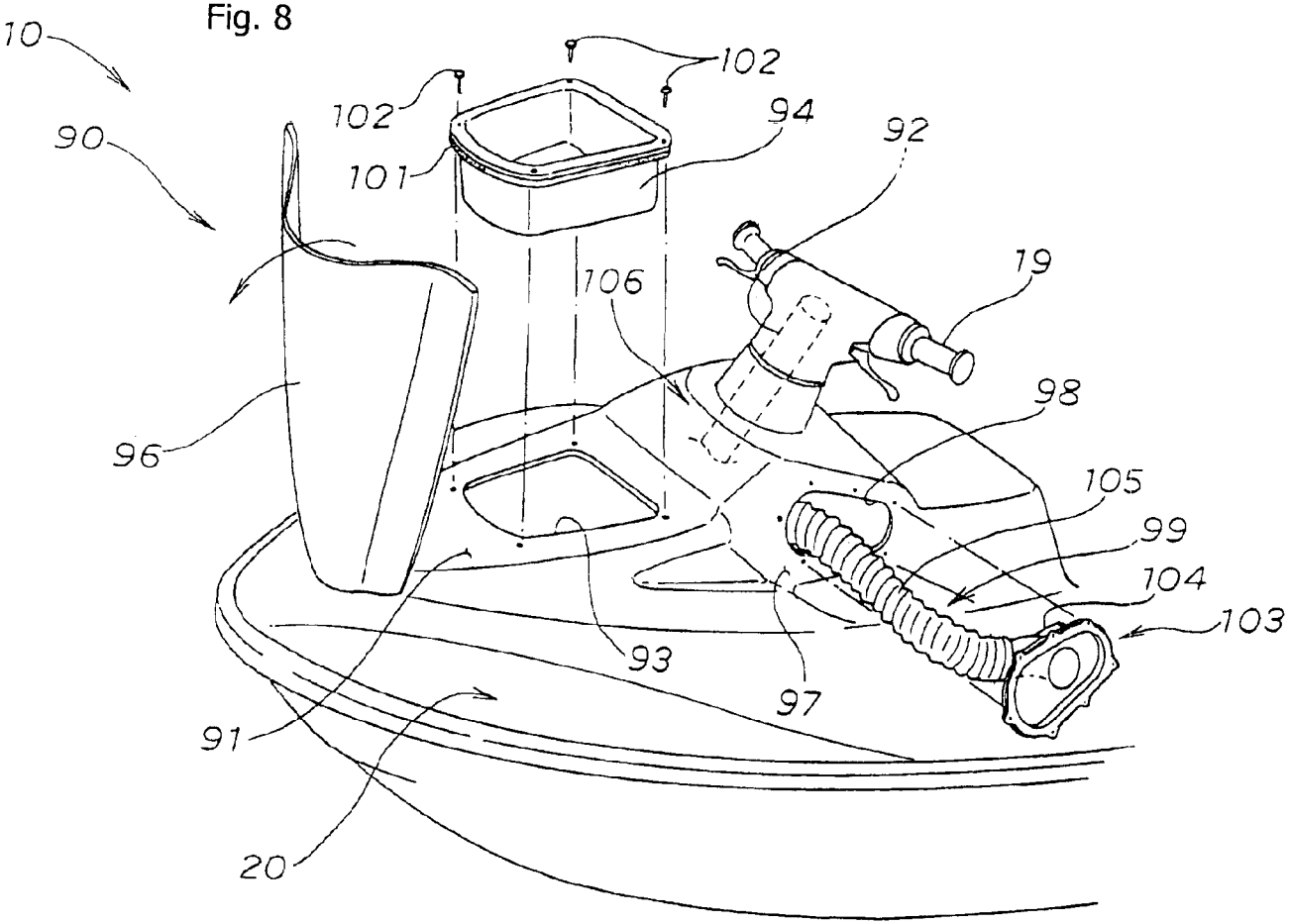
FIG. 8 is an exploded perspective view of a front portion of the personal watercraft which adopts the access port structure according to the present invention.

FIG. 8 is an exploded perspective view of a front portion of the personal watercraft which adopts the access port structure according to the present invention.

Main Service Opening

As shown in FIG. 8, the front portion of the deck 20 has a main service opening 93 formed therein in the proximity of a steering shaft 92, on a front portion upper face 91 of the deck 20. A box 94 is configured to fit nestingly inside of the main service opening 93 so as to be used as a container, and the box 94 is removably attachable to the upper face 91 of the deck 20 adjacent the main service opening. The main service opening 93 plays a role of an opening for maintenance when the front cover 96 is opened and the box 94 is removed.

Reference numeral 101 denotes a gasket interposed between the main service opening 93 and the box 94, and reference numerals 102 denote fastening screws for the box 94.

A front cover 96 is also provided on the upper face 91 of the deck 20. The front cover serves as a first lid for covering the top of the box 94, and the front cover may be attached to the deck 20 by a hinge (not shown).

Secondary Service Opening

The deck 20 also has a secondary service opening 98 serving as a maintenance opening formed in the front portion thereof in the proximity of the steering shaft 92, in a left side wall 97 serving as a side wall of the deck 20. A duct unit 99 is provided to cover and close up the secondary service opening 98.

The duct unit 99 is an air transfer conduit provided for expelling exhausting air from below the deck 20. The duct unit 99 includes a second lid 103 for closing up the secondary service opening 98 and exhausting air therethrough, and an exhaust duct 105 serving as an intake/exhaust duct attached to the attaching portion 104 of the second lid 103.

The secondary service opening 98 plays a role of an opening for maintenance when the second lid 103 is removed and the exhaust duct 105 attached integrally to the second lid 103 is pulled off.

In particular, it can be considered that an access port structure 90 for a personal watercraft is a structure that the main service opening 93 and the secondary service opening 98 are provided in the vicinity of the steering shaft 92.

For example, many rotatable members are present around the steering shaft 92. Therefore, where the main service opening 93 and the secondary service opening 98 are provided around the steering shaft 92, it is possible to hold one of the members with the left hand, and to concurrently perform a maintenance operation on the other member with the right hand.

Further, it can be considered that, according to the access port structure 90 hereof, when the secondary service opening 98 is closed up with the second lid 103, the second lid 103 serves also as the attaching portion 104 of the exhaust duct 105.

It is preferable, for example, to use an opening for maintenance also for another application in order to achieve efficient utilization of parts.

Therefore, when the secondary service opening 98 is closed up with the second lid 103, the second lid 103 also serves as the attaching portion 104 of the exhaust duct 105. Consequently, in a state of use, the second lid 103 is utilized as an exhaust port. However, when it becomes necessary to perform maintenance, the second lid 103 is removed, whereupon the exhaust duct 105 is pulled off simultaneously. Consequently, a maintenance operation can be performed.

As a result, efficient utilization of parts can be anticipated. Further, the number of openings for exclusive use for maintenance can be reduced, and improvement of the design of the personal watercraft 10 can be anticipated.

Figure 9:
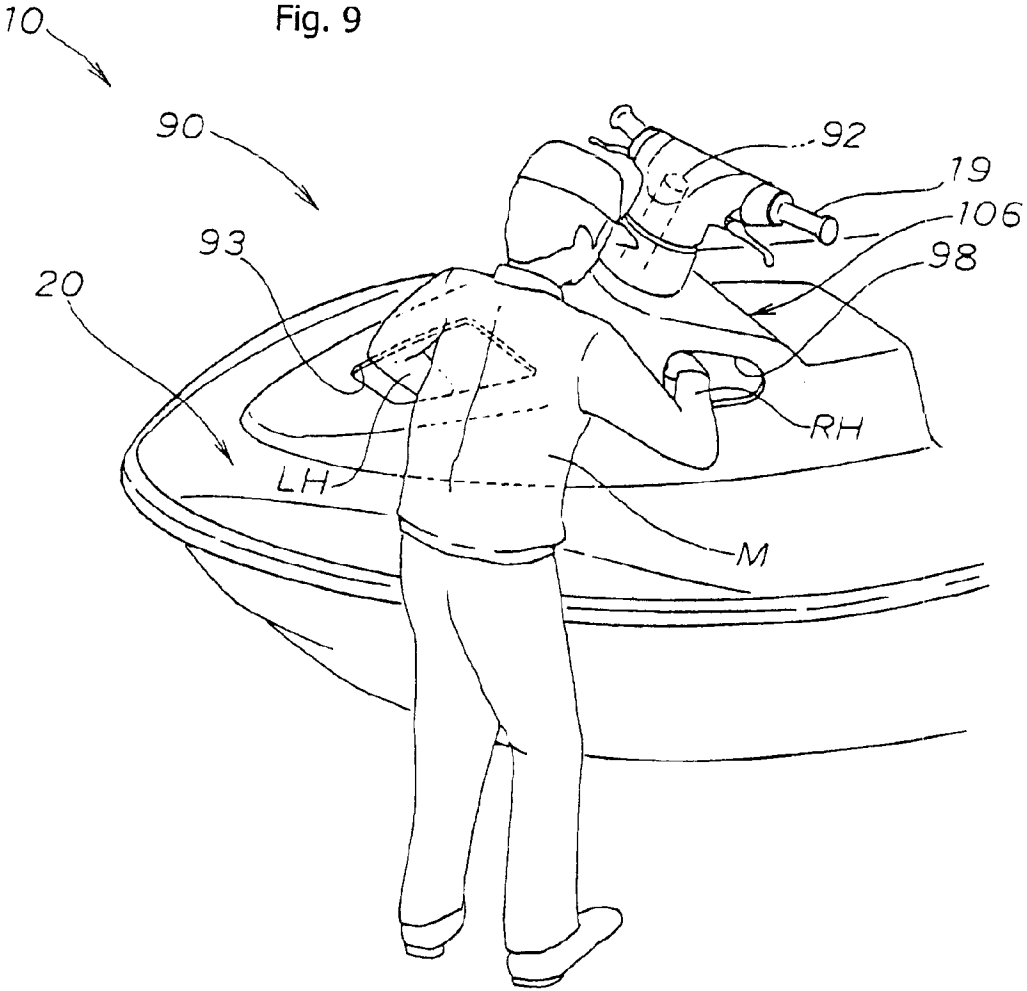
FIG. 9 is a perspective view showing an individual worker servicing a front portion of the personal watercraft which adopts the access port structure according to the present invention.

FIG. 9 is a perspective view showing an individual worker servicing a front portion of the personal watercraft with the access port structure according to the present invention.

Referring to FIG. 9, the access port structure 90 of the personal watercraft is configured with the main service opening 93 and the secondary service opening 98 situated close enough to one another so that a maintenance operation can be performed with one hand of an operator M inserted into the main service opening 93, and with the other hand of the operator M inserted into the secondary service opening 98.

For example, it is preferable that a maintenance operation can be performed making use of both of the openings at the same time, in order to improve the operability of the maintenance operation.

Therefore, the main service opening 93 and the secondary service opening 98 are ergonomically provided at positions close enough together so that the operator M can perform a maintenance operation with one hand thereof inserted into the main service opening 93, and with the other hand thereof inserted concurrently into the secondary service opening 98. Consequently, for example, the operator M can insert his left hand LH into the main service opening 93 and at the same time, can insert his right hand RH into the secondary service opening 98, to perform a maintenance operation using both hands simultaneously.

As a result, improvement of the operability of the maintenance operation can be achieved.

In the following, an example of a maintenance operation around the steering shaft 92 through the secondary service opening 98 is described.

Figure 10:
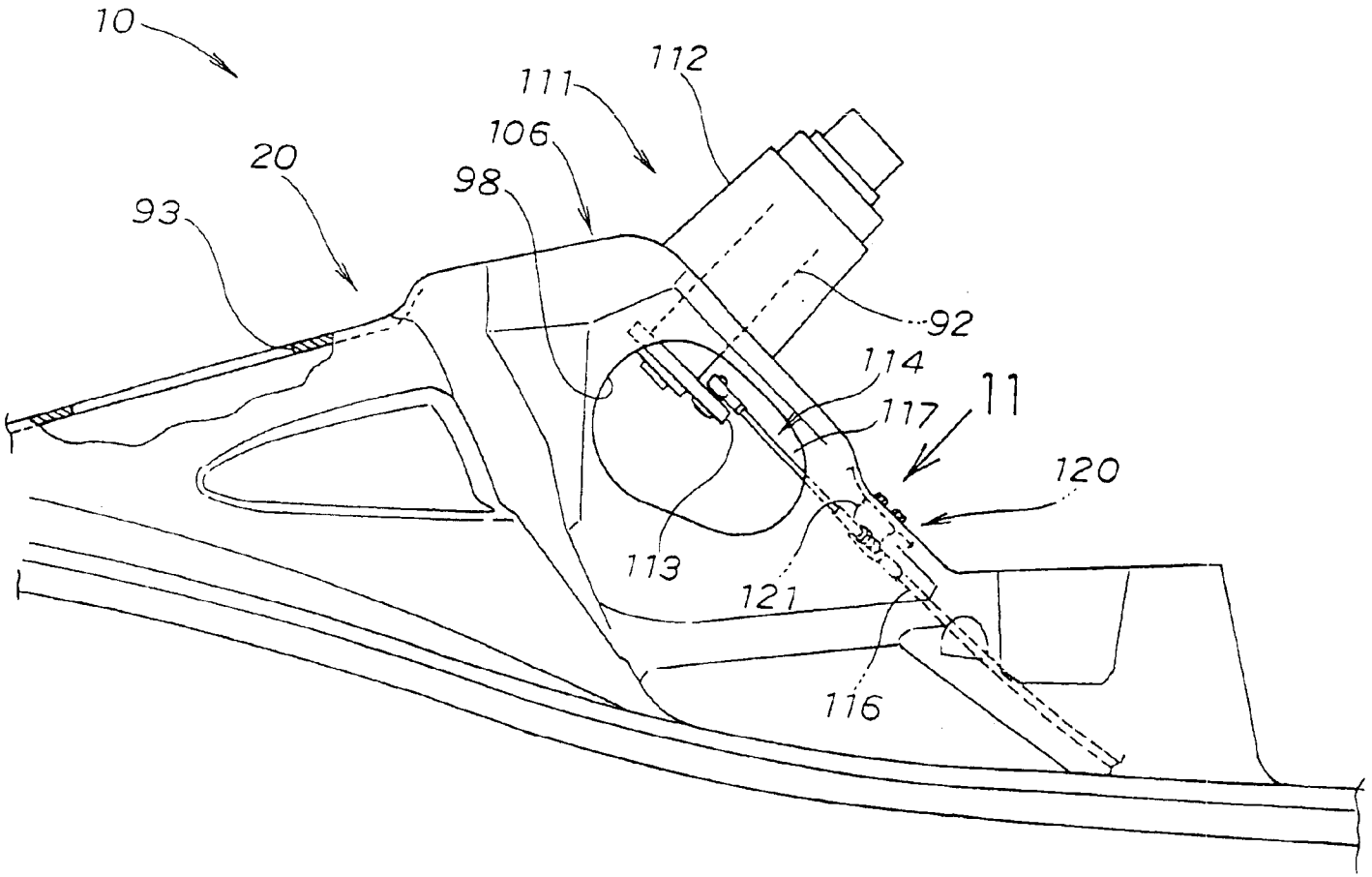
FIG. 10 is a side elevational view of an essential part of the personal watercraft which adopts the access port structure according to the present invention.

FIG. 10 is a side elevational view of an essential part of the personal watercraft which adopts the access port structure according to the present invention. A steering mechanism 111 includes the steering shaft 92 mounted for rotation in a steering hub 112. The steering handle member 19 (refer to FIG. 8) is attached to the upper end of the steering shaft 92, while a steering plate 113 is attached to the lower end of the steering shaft 92.

One end of a driving cable 114, serving as a connection member, is attached to the steering plate 113. The other end of the driving cable 114 is attached to the steering nozzle 18 (refer to FIG. 1) at the lower rear portion of the craft body 11.

It is to be noted that reference numeral 106 denotes an upwardly distended portion formed on the deck 20.

As noted, the front portion of the deck 20 of the personal watercraft distended upwardly to form the distended portion 106, and the steering handle member 19 (refer to FIG. 8) is rotatably supported at a central upper portion of the distended portion 106. In the embodiment depicted in the drawings, the access port structure 90 is formed in the distended portion 106. The steering handle member 19 and the steering nozzle 18 (refer to FIG. 1) are connected to each other by the driving cable (connection member) 114 disposed in the deck 20, with a maintenance opening (secondary service opening) 98 disposed in the left side wall (side wall) 97 of the distended portion 106.

Where the maintenance opening (secondary service opening) 98 is disposed in the left side wall 97 of the distended portion 106, maintenance of the driving cable 114 connecting to the steering handle member 19 (refer to FIG. 8) can be performed readily. As a result, improvement of the operability of the maintenance of the driving cable 114 can be anticipated.

The driving cable 114 includes a tubular outer sleeve 116, secured to a side of the craft body, and an inner cable 117 movable with respect to the outer sleeve 116. A supporting structure 120 for the driving cable is described with reference to the following figures.

Figure 11:
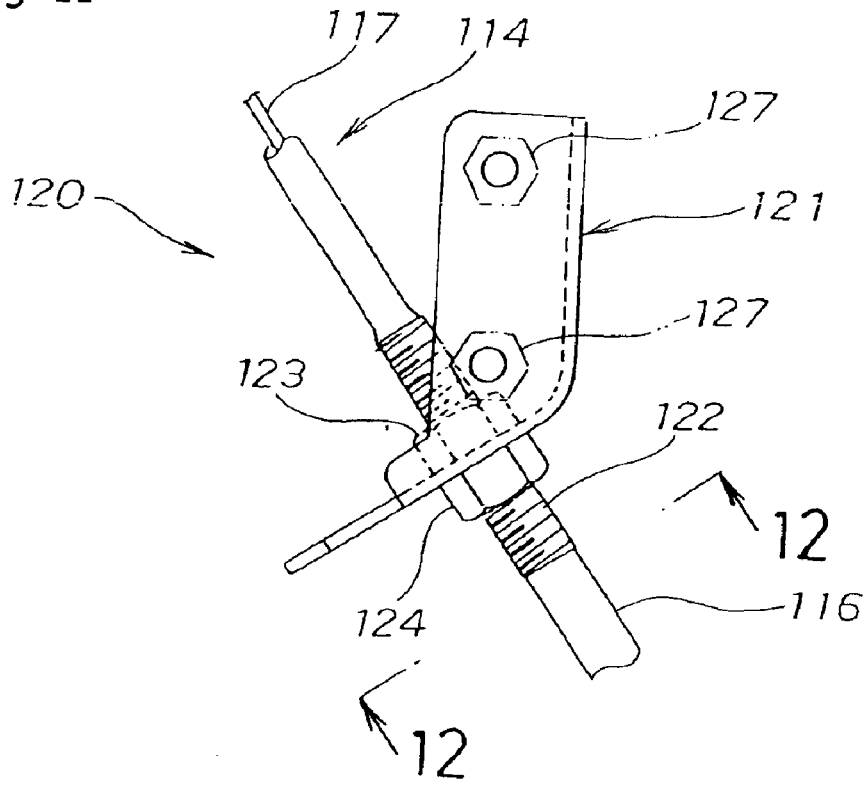
FIG. 11 is an enlarged view as viewed in the direction indicated by an arrow mark 11 in FIG. 10.
Figure 12:
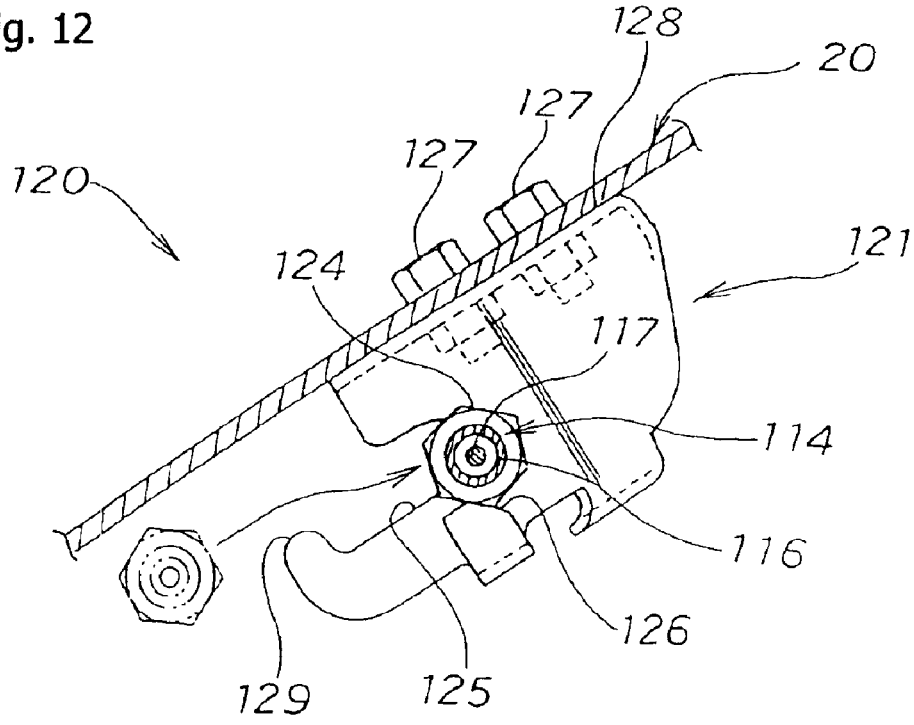
FIG. 12 is a sectional view taken along line 12—12 in FIG. 11.
Figure 13:
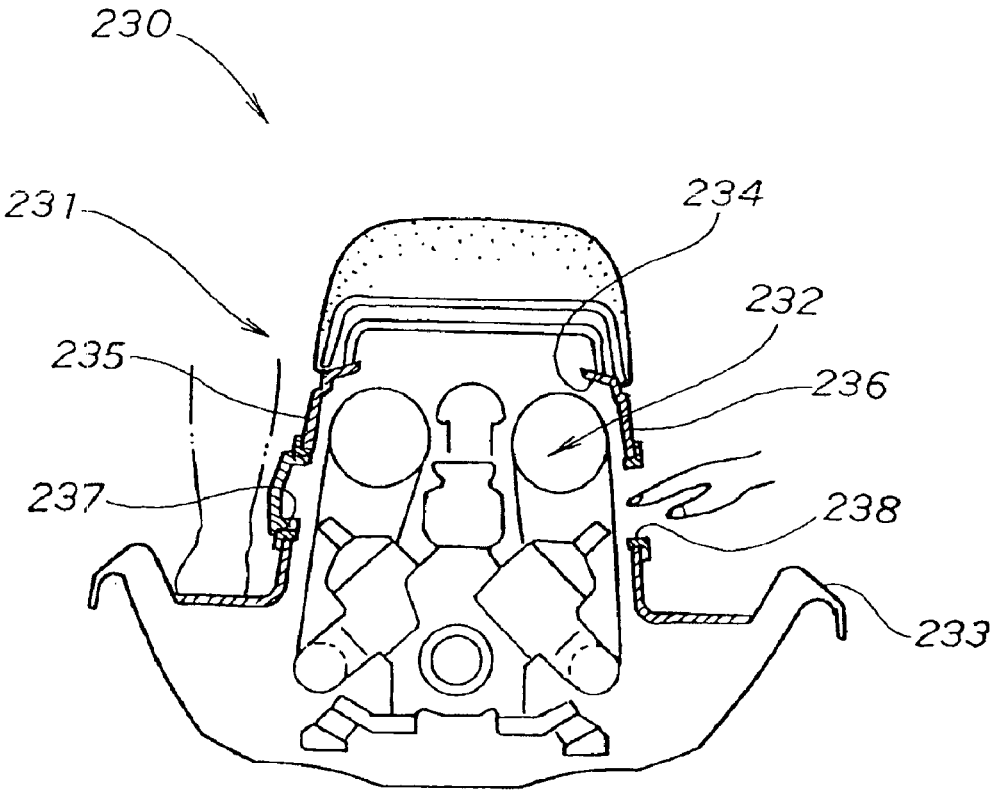
FIG. 13 is a reproduction of FIG. 3 cited from the specification of U.S. Pat. No. 5,743,206.

FIG. 11 is a view as viewed in the direction indicated by an arrow mark 11 of FIG. 10, and shows a plan of the supporting structure 120 for the driving cable. FIG. 12 is a sectional view taken along line 12—12 of FIG. 11 and shows a sectional view of the supporting structure 120 for the driving cable.

The supporting structure 120 for the driving cable 114 has a structure that the outer sleeve 116 of the driving cable 114 is supported on a bracket 121, attached to the underside of the deck 20 shown in FIG. 12. In particular, a male threaded portion 122 is formed on the outer sleeve 116, and first and second nuts 123 and 124 are screwed on the male threaded portion 122. A U-shaped slot 125 is formed in the bracket 121 shown in FIG. 12, and the outer sleeve 116 is secured by sandwiching the same in the U-shaped slot 125 with the first and second nuts of the outer sleeve 116.

Further, a stop member 126 for locking the position of, and stopping turning movement of the second nut 124 is formed on the bracket 121 as shown in FIG. 12. The stop member 126 is provided to prevent turning movement of the second nut 124, together with the first nut 123 shown in FIG. 11, when the first nut 123 is turned.

Accordingly, since the first nut 123 is positioned rather near to the secondary service opening 98 (refer to FIG. 10), the driving cable 114 can be removed or attached by turning the first nut 123. As a result, improvement of the operability in attachment and removal of the driving cable 114 can be achieved.

In FIGS. 11 and 12, reference numerals 127, 127 denote bolts for securing the bracket 121 to the reverse face of the deck 20, reference numeral 128 denotes a deck side attaching face of the bracket 121, and 129 denotes a projection formed on the bracket 121, for preventing the outer sleeve 116 from sliding out from the U-shaped portion 125 when the first nut 123 is loosened.

Although the present invention has been described herein with respect to a limited number of presently preferred embodiments, the foregoing description is intended to be illustrative, and not restrictive. Those skilled in the art will realize that many modifications of the preferred embodiment could be made which would be operable. All such modifications, which are within the scope of the claims, are intended to be within the scope and spirit of the present invention.

For example, in the depicted and described embodiment, the bridge plate 43 is removably attached to the rear portion opening 42 as shown in FIG. 2. However, it will be understood that the location of the bridge plate 43 is not limited to this, and it is only necessary to provide the bridge plate 43 as a boundary between the seat-underlying opening 41 and the rear portion opening 42.

Further, while, in the disclosed embodiment, the inner lid 45 is attached to the rear portion opening 42 at the rear portion of the craft body 11 (refer to FIG. 1) and the rear cover 48 is attached to the inner lid 45 as shown in FIG. 3, the configuration is not limited to this. In particular, the inner lid may be attached to any portion of the craft body, and the rear cover may be any cover which covers the inner lid.

Further, while, in the disclosed embodiment, the attaching portion 104 is provided on the second lid 103 and the exhaust duct 105 is attached to the attaching portion 104 as shown in FIG. 8, the exhaust duct may alternatively be an intake duct.

What is claimed is:

1. An access port structure for a personal watercraft having a craft body with a deck having a distended portion extending upwardly thereon and having equipment situated within said craft body below the deck, said access port structure situated to permit access to said equipment and comprising:

a main service opening formed in the distended portion of said deck and configured to allow access to selected components of said equipment, said main service opening situated so that an operator can perform a first maintenance operation by reaching therethrough with one hand; and a secondary service opening formed in the distended portion of said deck and configured to allow access to other selected components of said equipment without requiring the operator to access said main service opening;

wherein said secondary service opening is spaced sufficiently close to the main service opening to permit the operator perform a second maintenance operation, concurrent with the first maintenance operation, by reaching through the secondary service opening with his or her remaining hand while said one hand is extended through said main service opening.

2. The access port structure for a personal watercraft according to claim 1, wherein said main service opening and said secondary service opening are respectively provided in the deck proximate a steering shaft.

3. The access port structure of claim 1, further comprising a first lid for removably covering said main service opening, and a second lid for removably covering said secondary service opening.

4. An access port structure for a personal watercraft having a craft body with a deck, wherein a front portion of said deck is distended upwardly to form a distended portion, said personal watercraft having a steering handle member which is rotatably supported at a central upper portion of said distended portion, and a steering shaft operatively connected to said steering handle member;

said access port structure comprising at least one opening formed in an exterior side wall of said distended portion, and a lid which is removably attachable to said deck to temporarily cover said opening;

wherein said opening in said exterior side wall is substantially aligned with said steering shaft of said watercraft; and wherein the access port structure is configured such that the steering shaft is accessible upon removal of said lid from said opening in said exterior side wall.

5. The access port structure of claim 4, wherein said access port structure further comprises a main service opening formed in a top surface of said deck.

6. The access port structure of claim 5, further comprising a first lid for removably covering said main service opening, and a second lid for removably covering said opening in said side wall of said distended portion.

7. A personal watercraft comprising a craft body with a deck and having equipment situated within said craft body below the deck, said deck having a distended portion extending upwardly thereon with an access port structure situated therein to permit access to said equipment and comprising:

a main service opening formed in the distended portion of the deck and situated so that an operator can perform a first maintenance operation by reaching therethrough with one hand; and a secondary service opening formed in the distended portion of the deck and situated so as to permit the operator perform a second maintenance operation, concurrent with the first maintenance operation, by reaching through the secondary service opening with his or her remaining hand while said one hand is extended through said main service opening.

8. The personal watercraft of claim 7, wherein said main service opening and said secondary service opening are respectively provided in the deck proximate a steering shaft.

9. The personal watercraft of claim 7, further comprising a first lid for removably covering said main service opening, and a second lid for removably covering said secondary service opening.

10. The personal watercraft of claim 7, wherein a front portion of said deck is distended upwardly to form said distended portion, said personal watercraft having a steering handle member which is rotatably supported at a central upper portion of said distended portion; and wherein said secondary service opening is formed in a side wall of said distended portion.

11. The personal watercraft of claim 10, further comprising a first lid for removably covering said main service opening, and a second lid for removably covering said secondary service opening.

12. An access port structure for a personal watercraft having a craft body with a deck and having equipment situated within said craft body below the deck, said access port structure situated to permit access to said equipment and comprising:

a main service opening formed in the deck and situated so that an operator can perform a first maintenance operation by reaching therethrough with one hand; and a secondary service opening formed in the deck and spaced sufficiently close to the main service opening to permit the operator perform a second maintenance operation, concurrent with the first maintenance operation, by reaching through the secondary service opening with his or her remaining hand while said one hand is extended through said main service opening, wherein said second lid has an air flow opening formed therethrough, and wherein said second lid also serves as an attaching portion for an intake or exhaust duct.

13. An access port structure for a personal watercraft having a craft body with a deck, wherein a front portion of said deck is distended upwardly to form a distended portion, said personal watercraft having a steering handle member which is rotatably supported at a central upper portion of said distended portion, said access port structure comprising at least one opening formed in a side wall of said distended portion, wherein said access port structure further comprises a main service opening formed in a top surface of said deck, further comprising a first lid for removably covering said main service opening, and a second lid for removably covering said opening in said side wall of said distended portion wherein said second lid has an air flow opening formed therethrough, and wherein said second lid also serves as an attaching portion for an intake or exhaust duct.

14. A personal watercraft comprising a craft body with a deck and having equipment situated within said craft body below the deck, said deck having an access port structure situated therein to permit access to said equipment and comprising:

a main service opening formed in the deck and situated so that an operator can perform a first maintenance operation by reaching therethrough with one hand; and a secondary service opening formed in the deck and situated so as to permit the operator perform a second maintenance operation, concurrent with the first maintenance operation, by reaching through the secondary service opening with his or her remaining hand while said one hand is extended through said main service opening, further comprising a first lid for removably covering said main service opening, and a second lid for removably covering said secondary service opening, wherein said second lid has an air flow opening formed therethrough, and wherein said second lid also serves as an attaching portion for an intake or exhaust duct.

15. A personal watercraft comprising a craft body with a deck and having equipment situated within said craft body below the deck, said deck having an access port structure situated therein to permit access to said equipment and comprising:

a main service opening formed in the deck and situated so that an operator can perform a first maintenance operation by reaching therethrough with one hand; and a secondary service opening formed in the deck and situated so as to permit the operator perform a second maintenance operation, concurrent with the first maintenance operation, by reaching through the secondary service opening with his or her remaining hand while said one hand is extended through said main service opening, wherein a front portion of said deck is distended upwardly to form a distended portion, said personal watercraft having a steering handle member which is rotatably supported at a central upper portion of said distended portion; and wherein said secondary service opening is formed in a side wall of said distended portion, and further comprising a first lid for removably covering said main service opening, and a second lid for removably covering said secondary service opening, wherein said second lid has an air flow opening formed therethrough, and wherein said second lid also serves as an attaching portion for an intake or exhaust duct.

* * * * *

UNITED STATES PATENT AND TRADEMARK OFFICE

CERTIFICATE OF CORRECTION

PATENT NO. : 6,895,880 B2
DATED : May 24, 2005
INVENTOR(S) : Nakajima et al.

It is certified that error appears in the above-identified patent and that said Letters Patent is hereby corrected as shown below:

Column 5,
Line 63, change “attached to deck” to -- attached to the deck --.

Column 7,
Line 56, change “secure seat” to -- secure the seat --.

Column 8,
Line 54, change “member 60” to -- member 68 --.

Column 13,
Line 55, change “operator perform” to -- operator to perform --.

Column 14,
Line 37, change “operator perform” to -- operator to perform --.

Column 15,
Lines 3 and 34, change “operator perform” to -- operator to perform --.

Column 16,
Line 17, change “operator perform” to -- operator to perform --.

Signed and Sealed this

Sixth Day of December, 2005

JON W. DUDAS
*Director of the United States Patent and Trademark Office*